US005993157A

United States Patent [19]

Perfahl

[11] Patent Number: 5,993,157

[45] Date of Patent: Nov. 30, 1999

[54] CYCLOIDAL PROPELLER HAVING WINGS OPERATED BY HYDRAULIC CLUTCHES

[75] Inventor: Herbert Perfahl, Steinheim, Germany

[73] Assignee: Voith Hydro GmbH & Co. KG, Heidenheim, Germany

[21] Appl. No.: 08/929,818

[22] Filed: Sep. 15, 1997

[30] Foreign Application Priority Data

Sep. 17, 1996 [DE] Germany ..... 196 37 833

[51] Int. Cl.[6] ..... B63H 3/00

[52] U.S. Cl. ..... 416/111; 416/108; 416/112; 416/114; 416/155; 416/156; 416/158; 416/170 R

[58] Field of Search ..... 416/24, 98, 108, 416/111, 112, 114, 155, 156, 158, 170 R

[56] References Cited

U.S. PATENT DOCUMENTS

| | | | |
|---|---|---|---|
| 3,716,014 | 2/1973 | Laucks et al. | 115/35 |
| 4,225,286 | 9/1980 | Fork | 416/4 |
| 4,752,258 | 6/1988 | Hochleitner et al. | 440/93 |
| 4,859,106 | 8/1989 | Elsner et al. . | |
| 5,462,406 | 10/1995 | Ridgewell et al. | 416/111 |

FOREIGN PATENT DOCUMENTS

| | | |
|---|---|---|
| 1 192 945 | 3/1965 | Germany . |
| 1 941 652 | 2/1973 | Germany . |
| 3606549 A1 | 9/1987 | Germany . |
| 4019746 C1 | 8/1991 | Germany . |
| 4019747 C1 | 9/1991 | Germany . |
| 19602043 C1 | 3/1997 | Germany . |

OTHER PUBLICATIONS

Dubbel, Taschenbuch für den Maschinenbau; pp. 746–751.

Voith–Schneider–Propeller der intelligente Schiffsantrieb; pp. 1–11.

Dr.–Ing. Thomas Krist, Hydraulik Fluidtechnik, 8.1 Schubkolben–Hydrozylinder pp. 160–161.

*Primary Examiner*—Thomas E. Denion
*Assistant Examiner*—Ninh Nguyen
*Attorney, Agent, or Firm*—Randall J. Knuth

[57] ABSTRACT

A cycloidal propeller to achieve strictly a rudder operation includes accessory apparatuses containing accessory drives. Clutches are used to couple the accessory drives to the propeller shafts, and additional clutches are provided to disengage the fixed connection of the normal propeller mechanism to the wing shafts in cruising operation.

4 Claims, 8 Drawing Sheets

CYCLOIDAL PROPELLER HAVING WINGS OPERATED BY HYDRAULIC CLUTCHES

BACKGROUND OF THE INVENTION

1. Field of the Invention

The invention relates to a cycloidal propeller.

2. Description of the Related Art

Cycloidal propellers serve mostly as marine major drives, but may be used also as auxiliary drives, namely whenever especially high maneuverability is required. One type of cycloidal propeller is described in Voith document reprint 9.94 2000. The wing mechanism disclosed therein serves to move the wings on the wing circle of the rotor in the necessary positions to generate propelling forces, and also to control forces. Feathering is effected by way of a central joystick, which is actuated by two servomotors arranged at right angles to one another. The rotor is generally powered via a diesel engine with a gear drive comprising a bevel ring gear and a bevel pinion.

DE-B 19 41 652 describes a cycloidal propeller serving only as a marine auxiliary drive and which at cruising speed of the ship, is operated exclusively as a rudder. Feathering of the individual wings is effected by suitable accessory apparatuses to a degree such that in the so-called nonbuoyant, i.e., nonpropelling sailing position, they are parallel to one another and can in this position be adjusted to the necessary angular position by rotation of the rotor element according to the required rotor position.

DE 36 06 549 A1 describes a system to generate motion, or also drive, which in the broadest sense could be described also as a cycloidal propeller with multiple-part wings, i.e., composite wing profile. Gear wheels are primarily used as an actuating drive for the wing components, and for one the rear wing part, in the last part of the drive train formed of a chain of gear/wheels, consists of a gear segment and a gear wheel mounted on the shaft end of the rear wing part.

DE-AS 11 92 945 is geared to safety against wing damage by foreign objects and provides safety valves for relieving the pressure spaces of the drive servomotors in case external forces exerted on the wings by foreign objects would cause an unallowable pressure increase in the pressure spaces.

In the case of the cycloidal propeller described in the not prepublished older document DE 196 02 043 C1, a large actuation option of the wing is achieved by a gear drive fitted between the linkages of the wing mechanism and the respective wing shaft consisting predominantly of a gear segment and a gear wheel.

But the design of the cycloidal propeller, notably concerning the configuration of the propeller mechanism and attachment to the wing shaft, results in relatively short feathering paths of the wings. Therefore, it is not possible to bring the rounded head end of the wings in a forward direction of travel. Therefore, wing profiles are used that deviate from the usual shape and have an essentially oval shape. At certain states of travel this is unfavorable, for example when the ship travels within narrow channels, in harbors or in the skerries. In such states of travel, it is advantageous to drive the ship using the cycloidal propeller, and not the main drive, which is configured for a considerably higher speed. The high maneuverability of the cycloidal propeller is utilized here.

SUMMARY OF THE INVENTION

The invention comprises a cycloidal propeller including a stator and a rotor mounted rotatably to the stator. The rotor has an axis of rotation and a plurality of wings having shafts pivotally mounted to the rotor with a swivel axis. The rotor axis of rotation and the swivel axes of the wings are substantially parallel to each other.

A propeller mechanism is included for actuation of the wings using a joystick connected to the wings by a linkage.

A means is also included for causing actuation of the wings to a sailing position where the wings are parallel to each other. The means is also able to actuate the wings from a sailing position to a rudder position, with the means coupled to a respective wing shaft by a releasable clutch.

An additional clutch is provided with each wing for separating the each wing from the propeller mechanism.

An objective underlying the invention is to design a cycloidal propeller such that a separation is brought about between the regular propeller mechanism and the accessory apparatuses.

This objective is intentionally satisfied by the features of offering the advantage that the usual propeller mechanism can be used and that the accessory apparatuses can be selectively configured.

BRIEF DESCRIPTION OF THE DRAWINGS

The invention is explained hereafter with the aid of the drawing figures, which show the following.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
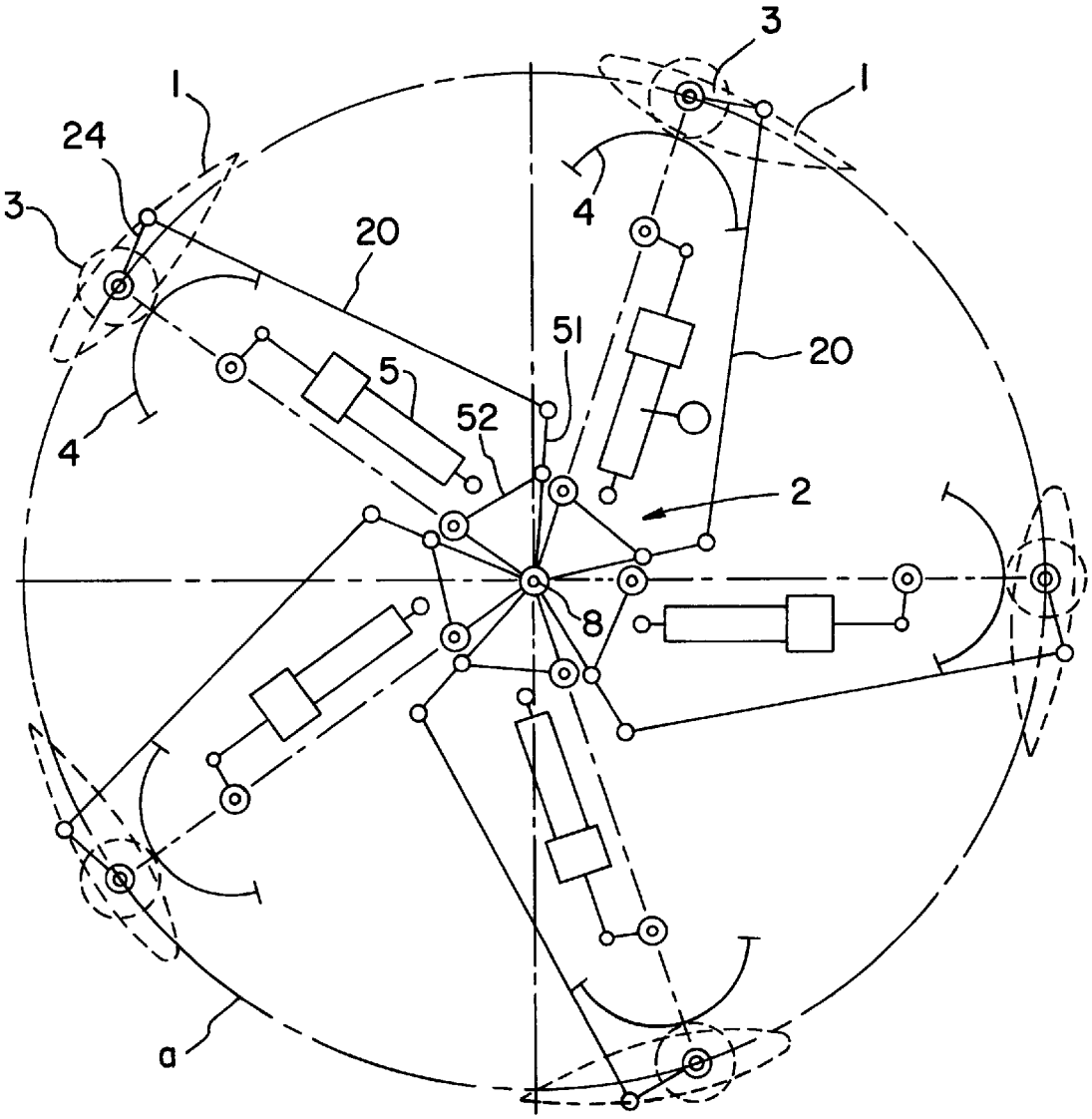
FIG. 1 is a schematic plan view of the rotor with the wings in normal position.
Figure 3:
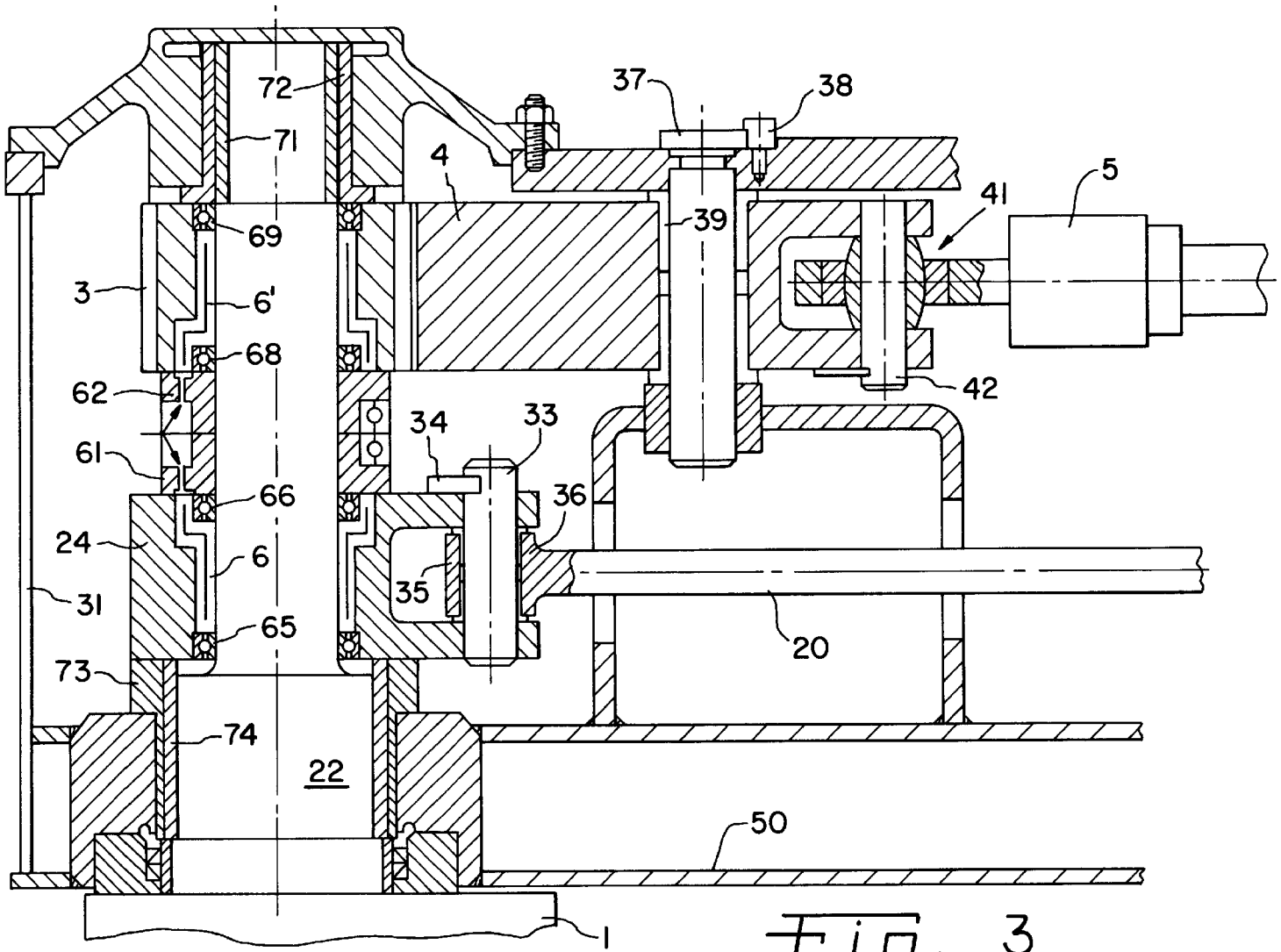
FIG. 3 is a cross section through the outer area of the rotor element.

According to FIG. 1, five wings 1 are contained on the wing circle a of the rotor, or rotor element 50 (refer to FIG. 3). The arrangement is shown in the zero position, in which the individual wings, i.e., more exactly, the profile rails of the wings, extend tangentially to the wing circle a. The joystick with its center 8 is exactly in the center of the wing mechanism 2. Sketched here is the so-called slider-crank mechanism with the oscillating crank 51, connecting rod 52 and coupling rod 20 attaching by way of the wing drive lever 24 to the relevant wing 1.

FIG. 3 shows this structure still more accurately. The coupling rod 20 is hinged with its bearing eye 35, by means of bearing pin 33 secured by axle disk 34, by way of bearing 36 to the drive lever 24 of the wing. This connection is releasable in operation by the hydraulically actuated clutch 6. The configuration of said clutch may be, e.g., according to the German patent documents DE-C 40 19 746 or DE-C 40 19 747 or the U.S. Pat. No. 4,859,106. A number of releasable clutches are illustrated in Dubbel Taschenbuch des Maschinenbaus (Mechanical Engineering Handbook) on pages 746 through 750. But they are for the most designed only for axially aligned shafts or, except for the Airflex clutch illustrated in FIG. 82, not very well suited for other reasons for the purpose on hand here. However, the handbook refers in a note to other suitable hydrostatic clutches.

Figure 2:
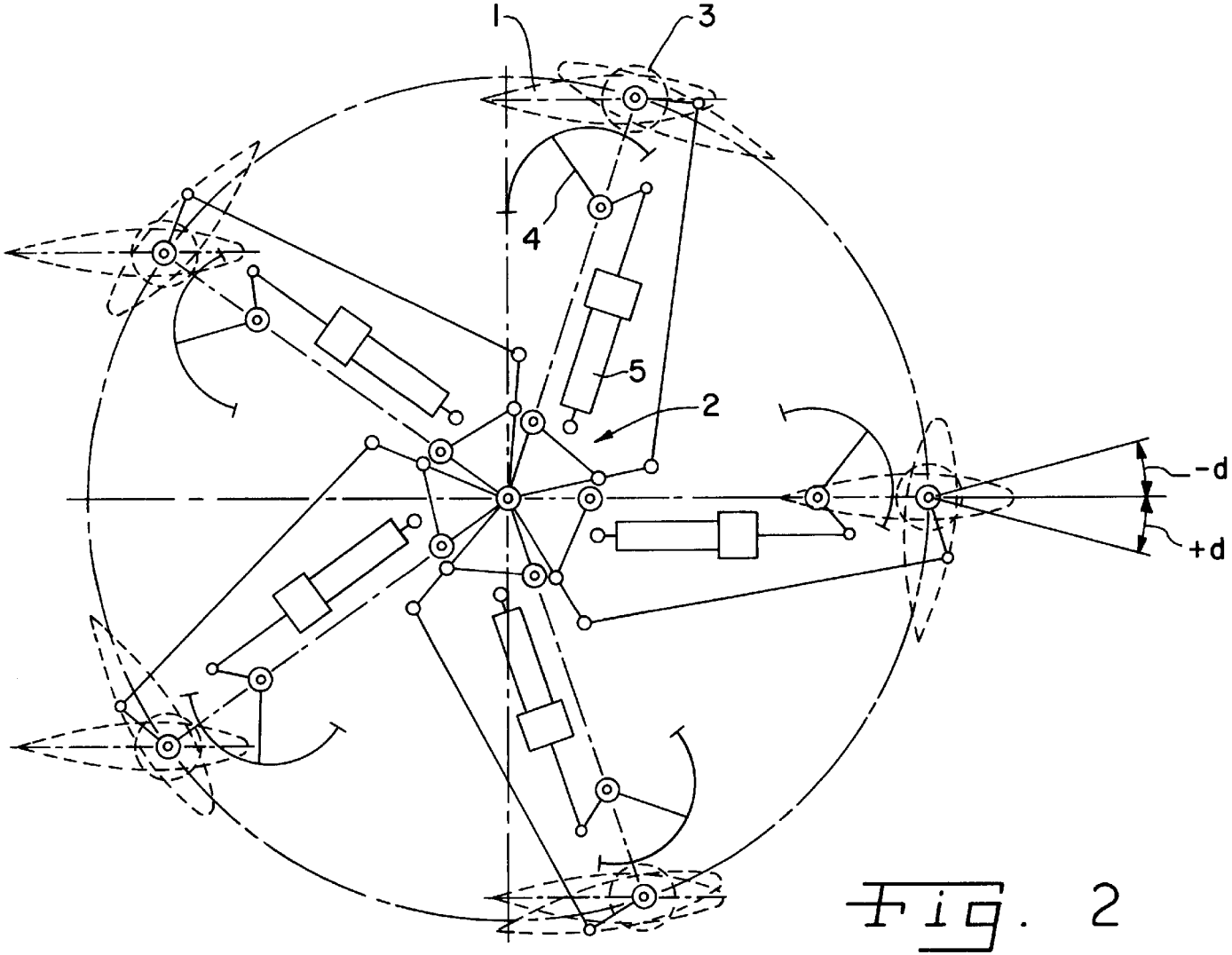
FIG. 2 is a similar plan view of FIG. 1, with wings feathered to sailing position, each wing in a basic view.

With the clutch released, the propeller mechanism, i.e., presently the drive lever 24, is detached from the propeller shaft, making the proper shaft, and thus the wing, freely movable by the accessory apparatuses, with the radially inner clutch part resting via the bearings 65 and 66 on the wing shaft. The wing drive according to the accessory apparatuses consists of the relevant hydraulic cylinder 5, which by means of bearing 41 and bearing pin 42 attaches to the fork of a gear segment 4. Said gear segment is mounted in the rotor element 50 by means of bearing pins 37 secured by screw 38, and by means of bearing 39. Its teeth mesh with those of a gear 3, which, in turn, can be locked to the wing shaft 22 by way of the clutch 6', which is configured the same as clutch 6. With the clutch disengaged, the radially inner part of the clutch and the gear 3 rest via bearing 68, or 69, on the wing shaft. Illustrated is yet another bearing 72 with bearing bushing 71, said bearing serving to mount the wing shaft on the rotor element. The bottom bearing of the wing shaft is referenced 73 here, the pertaining bearing bushing is reference 74. The radially outer boundary of the rotor element is the vertical wall 31. The gear drive has a large gear ratio, such that relatively small actuating motions of the hydraulic jack 5 produce a large swivel angle of gear 3, respectively the wing shaft 22 along with it, and thus of the wing 1, as can be seen from FIG. 2.

The illustrated measures make it possible to adjust each wing with normal profile to the desired rudder position without any impediment, and at that, with the thick rounded head end in the ship's direction of travel. The hydraulic fluid supply to the clutches 6 and 6' is effected here by way of clamping rings 61 and 62, to which the fluid supply is connected. The clutches are now either closed while the clutches 6' are released, allowing actuation of the wing shafts either by the regular propeller mechanism or by the accessory apparatuses. The procedure is practically such that the normal propeller mechanism sets the wings tangential to the wing circle, before the clutches pertaining to this mechanism are released. Next, the clutches 6' of the accessory apparatuses are closed, the propellers adjust first to the parallel sailing position and continue then adjusting to the required rudder position.

Figure 4:
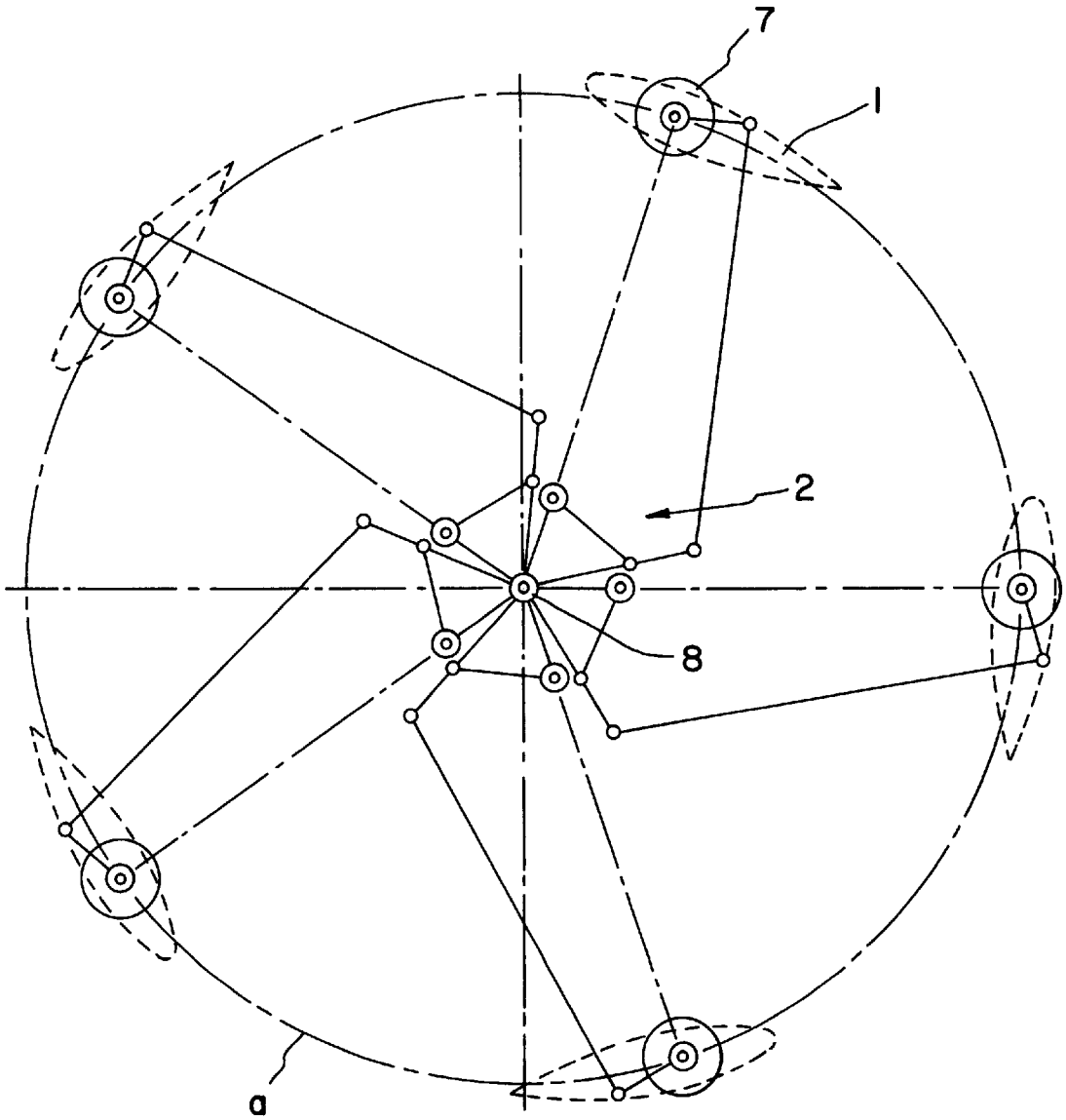
FIG. 4 is a plan view of the rotor in another embodiment with the wings in normal position.
Figure 5:
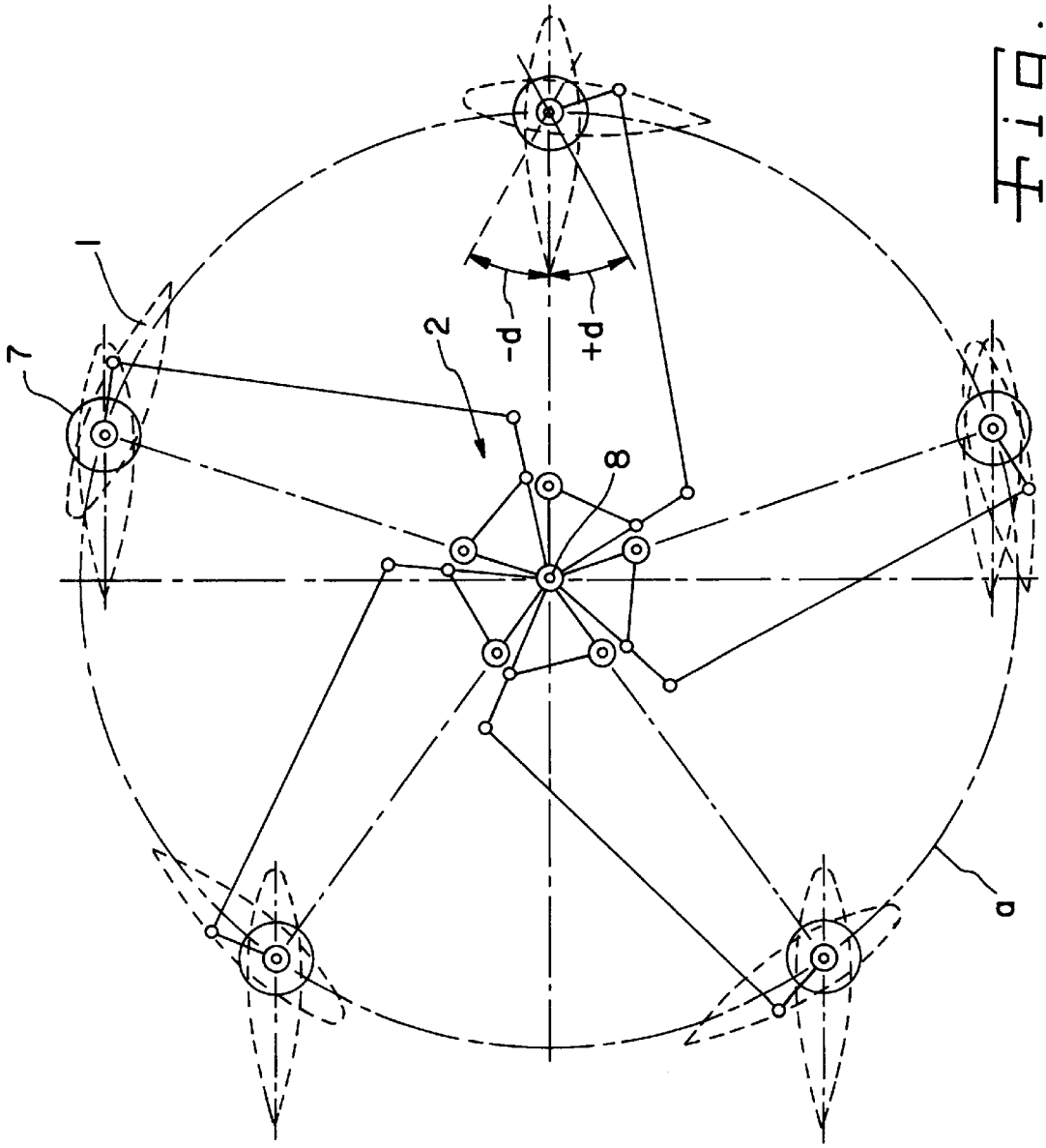
FIG. 5 is a similar plan view of FIG. 4, with the wings feathered to sailing position, each in a basic view.
Figure 6:
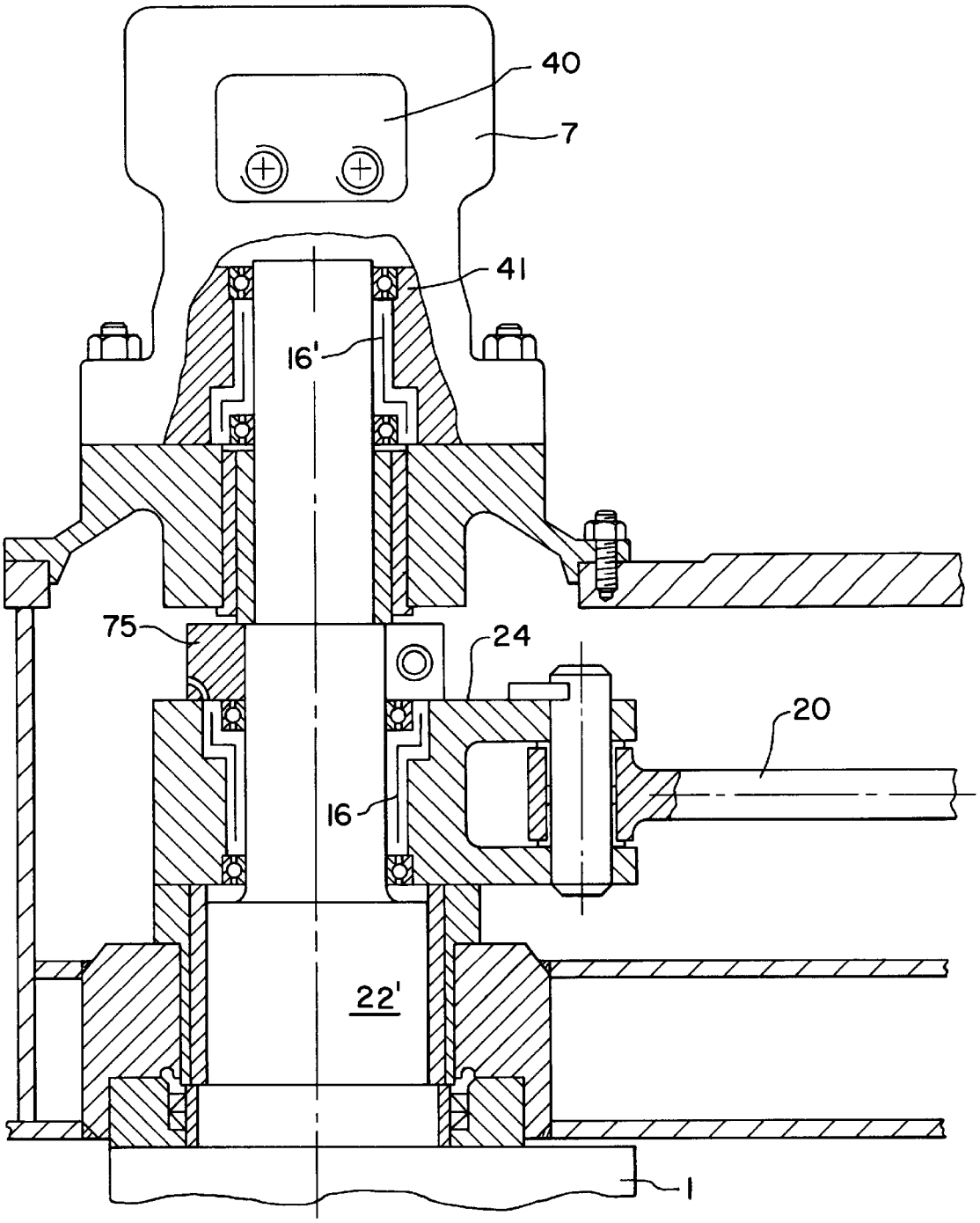
FIG. 6 is a cross section view through the outer area of the rotor.
Figure 8:
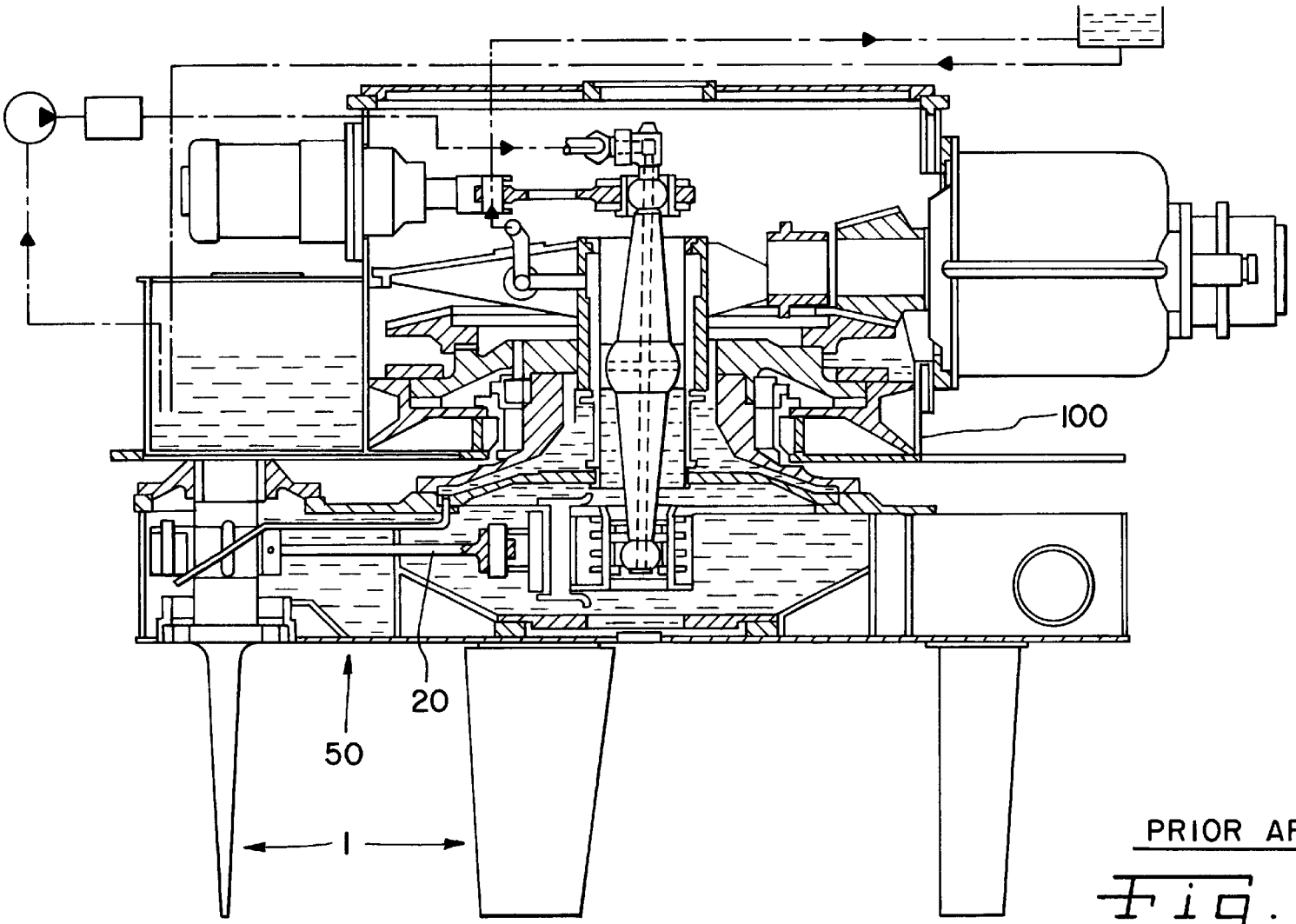
PRIOR ART Fig. 8

Another embodiment illustrated in FIG. 4 through 6, has the same components as the propeller mechanism 2 in FIG. 3 and 4 and the wings 1. Indicated additionally is a swivel motor 7 coordinated with the individual wing shafts, as can be seen in more detail in FIG. 6. Such motor have a very large swivel angle, for instance up to 270°, such as described, e.g., in the book "Hydraulik-Fluidtechnik" (Hydraulic Fluidics) by Thomas Krist, under 8.1 Thrust Piston Hydrocylinders, FIG. 8.1.2 d. Such swivel motor is basically illustrated also in the initially mentioned German disclosure, but is equipped there only for a limited swivel angle, of about 90°. The coupling to the wing shaft 22' is established here via an adapter sleeve 41. Contained between said sleeve and the wing shaft is the clutch 16'; a further clutch 16 is contained between the drive lever 24 of the wing shaft pertaining to the propeller mechanism 2 and is hinged to the coupling rod 20. This equals practically the structure relative to FIG. 3. Illustrated additionally, on swivel motor 7, is the connecting plate 40 for the hydraulic fluid lines. The hydraulic fluid supply and release is controlled with the aid of valves known from hydraulic engineering. Provided for the hydraulic fluid supply to the clutch 16 is the clamping ring 75. Applicable in the case of the present variant, analogous to the first variant, is that either the clutches 16 are closed and the clutches 16' released or vice versa.

Figure 7:
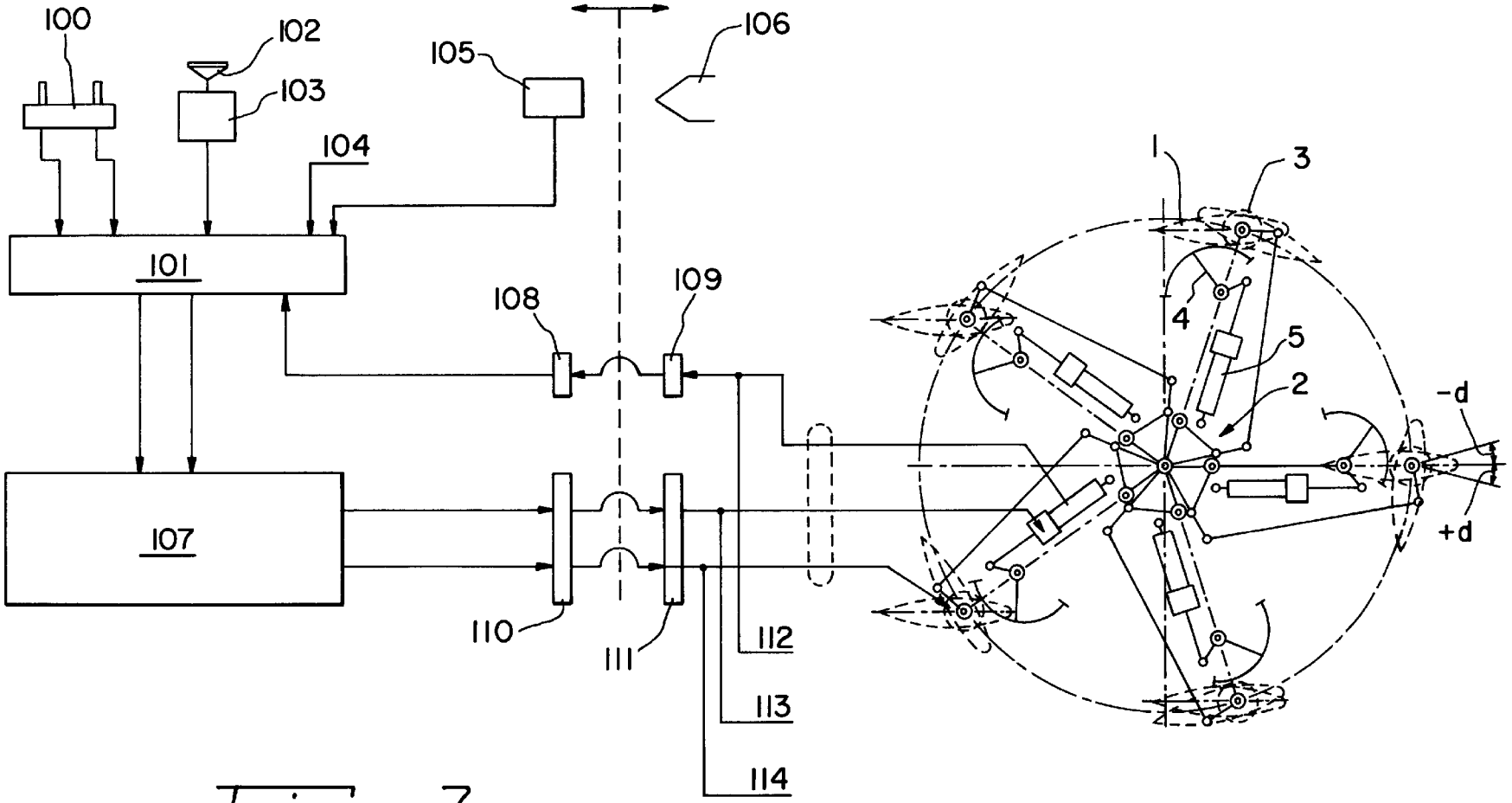
FIG. 7 is a schematic of the controller for the rudder operation (i.e., for propellers with a dual mechanism) and, FIG. 8 is an elevational view of a prior art cycloidal propeller with a stator 100.

The following addresses FIG. 7. Schematically illustrated, the cycloidal propeller comprises the following essential components:

| | |
|---|---|
| 1 | Wing |
| 2 | Propeller mechanism |
| 3 | Gear wheel |
| 4 | Gear segment |
| 5 | Hydraulic cylinder |
| 100 | Switching system for clutches |
| 101 | PLC controller |
| 102 | Rudder wheel |
| 103 | Control signal generator |
| 104 | Input from compass |
| 105 | Limit switch to lock the rotor |
| 106 | Cam for locking the rotor |
| 107 | Hydraulic fluid supply with hydraulic valves |
| 108 | Electric terminal on stator |
| 109 | Electric terminal on rotor |
| 110 | Hydraulic connection on stator |
| 111 | Hydraulic connection on rotor |
| 112 | Pitch feedback |
| 113 | Hydraulic fluid for hydraulic cylinder |
| 114 | Hydraulic fluid for clutches |

Both the clutches and hydraulic cylinders are connected via hoses and piping with quick-action couplings attached to the outside of the rotor. The mating components to the quick-action couplings, the valves and the pertaining fluid supplies for the clutches and hydraulic cylinders are contained on the stator of the propeller. With the propeller operating in normal operation, i.e., the wing driven by the mechanism, no hydraulic fluid supply is required. Hence, no rotary hydraulic fluid couplings are required. The quick-action couplings are closed not until the propeller is at standstill, thereby establishing a connection of the clutches and hydraulic cylinders to their respective fluid supplies.

In the simplest case, the quick-action couplings are closed manually. The procedure can be automated easily, for example, by way of a hydraulically or pneumatically actuated apparatus.

The same is true for the electrical connection to the displacement transducers contained in the hydraulic cylinder. Here, too, the electrical connection is not required until the rotor is at standstill.

Description of Wheel Element Blocking

Stopping and blocking the rotor may be envisaged as follows:

The rotor features a cam for activation of a limit switch on the stator. As the propeller is shut down, the rotor stops at any point, but continues to be rotated then until the cam actuates the limit switch. Next, the propeller is locked against further rotation on the propeller input shaft, for example, by means of a disk brake or a plain mechanical lockout.

Description of Control

The propeller is in normal operation controlled via a known standard controller.

In the rudder operation, with the rotor at standstill, control is effected by means of a handwheel, which by means of a rotary potentiometer feeds control pulses to an PLC controller. The output signals control solenoid valves, which, in turn, effect the control of the hydraulic cylinders, and thus the required wing actuation. The control procedure can also be automated, using a signal from the ship's compass.

The description of the control and hydraulic fluid supply applies analogously also to the use of a swivel motor, instead of a hydraulic cylinder.

Accomplished with the proposed invention is a genuine sailing position, and additional rudder angles can be adjusted. The propeller is thus a substitute for an additional rudder, since all of the wings are rotated by a common angle, thus generating a thrust in a desired direction.

Major elements are the gear wheel 3, gear segment 4 or, alternatively, the swivel motor. These elements make it possible to swivel the wing to any desired position.

The wing actuation for rudder operation is carried out with the rotor at standstill. Hydraulic and electrical connections are required only with the rotor at standstill. Therefore, plain commercially available connectors (e.g., quick-action couplings) can be used.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A cycloidal propeller comprising:

a stator;

a rotor mounted rotatably to said stator, said rotor having an axis of rotation and a plurality of wings having shafts pivotally mounted to said rotor with a swivel axis, said rotor axis of rotation and said swivel axes of said wings substantially parallel to each other;

a propeller mechanism for actuation of said wings using a joystick connected to the wings by a linkage;

means for causing actuation of said wings to a sailing position where said wings are parallel to each other, said means actuating said wings from a sailing position to a rudder position, said means coupled to a respective wing shaft by a releasable clutch; and a clutch provided with each wing for separating said each wing from the propeller mechanism.

2. The cycloidal propeller of claim 1, in which said actuation means comprises:

a hydraulic cylinder;

a gear drive having a gear wheel concentrically circumscribing a said wing shaft; and a gear segment to which said hydraulic cylinder is hinged, said releasable clutch arranged between said gear wheel and a said wing shaft.

3. The cycloidal propeller of claim 1, including a plurality of swivel motors, each coupled to a said wing shaft by means of said releasable clutch.

4. The cycloidal propeller of claim 3, said swivel motor coupled to a said wing shaft via a sleeve-shaped adapter member, said clutch being fitted between said adapter and a said wing shaft.

* * * * *